US008754730B2

(12) United States Patent
Kimura et al.

(10) Patent No.: US 8,754,730 B2
(45) Date of Patent: Jun. 17, 2014

(54) ELECTROMAGNETICALLY OPERATED SWITCHING DEVICE

(75) Inventors: Toru Kimura, Tokyo (JP); Tomotaka Yano, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/504,208

(22) PCT Filed: Jan. 13, 2010

(86) PCT No.: PCT/JP2010/050279

§ 371 (c)(1),
(2), (4) Date: Apr. 26, 2012

(87) PCT Pub. No.: WO2011/086670

PCT Pub. Date: Jul. 21, 2011

(65) Prior Publication Data

US 2012/0212307 A1 Aug. 23, 2012

(51) Int. Cl.

| | |
|---|---|
| ***H01H 9/00*** | (2006.01) |
| ***H01H 3/00*** | (2006.01) |
| ***H01H 33/66*** | (2006.01) |
| ***H01H 9/42*** | (2006.01) |
| ***H01H 33/666*** | (2006.01) |
| *H01H 31/00* | (2006.01) |

(52) U.S. Cl.

CPC ..... *H01H 33/666* (2013.01); *H01H 31/003* (2013.01)

USPC ..... 335/177; 335/103; 335/109; 335/119; 335/136; 335/184; 335/189; 335/127; 335/132; 335/267; 218/120; 218/140; 218/153; 218/154

(58) Field of Classification Search

USPC ..... 335/177, 103, 109, 119, 136, 184, 189, 335/127, 132, 197, 267; 218/120, 140, 153, 218/154

See application file for complete search history.

(56) References Cited

U.S. PATENT DOCUMENTS

| | | | | | |
|---|---|---|---|---|---|
| 687,690 | A | * | 11/1901 | Lake | 335/177 |
| 1,014,300 | A | * | 1/1912 | Hart | 335/174 |
| 3,548,353 | A | * | 12/1970 | Bausch | 335/276 |

FOREIGN PATENT DOCUMENTS

| | | | | |
|---|---|---|---|---|
| GB | 190915075 | A | * | 0/1910 |
| GB | 191112828 | A | * | 0/1910 |
| JP | 57-115720 | A | | 7/1982 |
| JP | 7-335095 | A | | 12/1995 |
| JP | 9-147701 | A | | 6/1997 |
| JP | 2007-123230 | A | | 5/2007 |
| RU | 2137240 | C1 | * | 9/1999 |
| RU | 2138876 | C1 | * | 9/1999 |
| WO | 2007/010608 | A1 | | 1/2007 |

OTHER PUBLICATIONS

International Search Report (PCT/ISA/210) issued on Apr. 6, 2010, by Japanese Patent Office as the International Searching Authority for International Application No. PCT/JP2010/050279.

* cited by examiner

*Primary Examiner* — Mohamad Musleh

(74) *Attorney, Agent, or Firm* — Buchanan Ingersoll & Rooney PC

(57) ABSTRACT

An electromagnetically operated switching device according to the present invention includes a pair of electromagnetically operated mechanisms for driving a main circuit contact of a switch via a link mechanism symmetrically arranged with respect to an operational center axis, and a length of a spring retaining plate can be regulated in accordance with a change of a link ratio, which is caused by a design change of the main circuit contact.

12 Claims, 3 Drawing Sheets

ELECTROMAGNETICALLY OPERATED SWITCHING DEVICE

BACKGROUND OF THE INVENTION

1. Technical Field

The present invention relates to a switching device used for an electric power transmission-distribution facility, an electric power receiving facility and the like, and particularly relates to an electromagnetically operated switching device that is driven by an electromagnetically operated mechanism so as to open/close a main circuit contact of a switch.

2. Background Art

In conventional electromagnetically operated switching devices, there is a well-known switching device as illustrated in, for example, FIG. 1 through FIG. 7 in Patent Document 1, in which a main circuit contact of a switch, an insulation rod, a driving rod, a coil spring for applying a contact pressure to the main circuit contact, and a spring-support portion of the coil spring are arranged along the same axis (center axis), and then, driving forces of a plurality of electromagnetically operated mechanisms, which are symmetrically arranged with respect to the axis, are transmitted, via a link mechanism including a driving lever and the like, to the coil spring, the spring-support portion, the driving rod, and the insulation rod, whereby the main circuit contact is opened or closed.

CONVENTIONAL ART DOCUMENT

Patent Document

Patent Document 1: Japanese Laid-Open Patent Publication No. 2007-123230

SUMMARY OF THE INVENTION

Problems to be Solved by the Invention

In the conventional electromagnetically operated switching device as described above, because the driving forces transmitted from a plurality of electromagnetically operated mechanisms, which are symmetrically arranged, are combined by linking to one shaft of the spring-support portion via a link mechanism, a mount number or a position of the (0004) electromagnetically operated mechanisms must be changed in accordance with a design change, such as a change of a stroke or a contact pressure, of a main circuit contact, which is determined by an insulation level, a continuous passing current, or a short-time current of the main circuit of the switch, every time when a design is changed, so that there have been many problems in that a manufacturing cost of the conventional switching device is increased and the switching device gets larger, whereby the design change causes a trouble due to a space limitation for installing the switching device. Moreover, because a link ratio is changed in accordance with the design change, such as the change of the stroke or the contact pressure, of the main circuit contact, a driving lever must be replaced, every time when the link ratio is changed.

The electromagnetically operated switching device of the present invention has been made to solve above-described problems, and an object of the invention is to provide a link mechanism that can be accommodated to a change of a link ratio according to a change of a stroke or a contact pressure, without affecting an arrangement of an electromagnetically operated mechanism or an arrangement of a link mechanism, by regulating a length of the spring retaining plate in a rectangular direction with respect to an operational center axis, even when a design change for the stroke or the contact pressure of a main circuit contact, which is determined by an insulation level, a continuous passing current, or a short-time current of the main circuit of the switch, is performed.

Means for Solving Problems

An electromagnetically operated switching device of the present invention includes electromagnetically operated mechanisms for opening/closing a main circuit contact of a switch; a link mechanism for transmitting operation forces of the electromagnetically operated mechanisms to the main circuit contact of the switch; a driving rod that is arranged along an operational center axis of the main circuit contact; a contact-pressure spring that is disposed around the driving rod and applies a contact pressure necessary to the main circuit contact; and a spring retaining plate that can be slidably linked to the driving rod so as to retain the contact-pressure spring; wherein a distance from the spring retaining plate to a link point of the spring retaining plate and an interlocking link can be regulated in accordance with a design change of a main circuit contact.

Effects of the Invention

According to the electromagnetically operated switching device of the present invention, an effect can be provided, in which a total length of a link mechanism can be regulated without changing an arrangement of an electromagnetically operated mechanism, in other words, a configuration or an attachment position of the electromagnetically operated mechanism, even when a link ratio is changed in accordance with a change of a stroke or a contact pressure, and the switching device can be accommodated to a change of the stroke or the contact pressure, while a shared use of the electromagnetically operated mechanism is advanced.

BEST MODE FOR CARRYING OUT THE INVENTION

Embodiment 1

Figure 1:
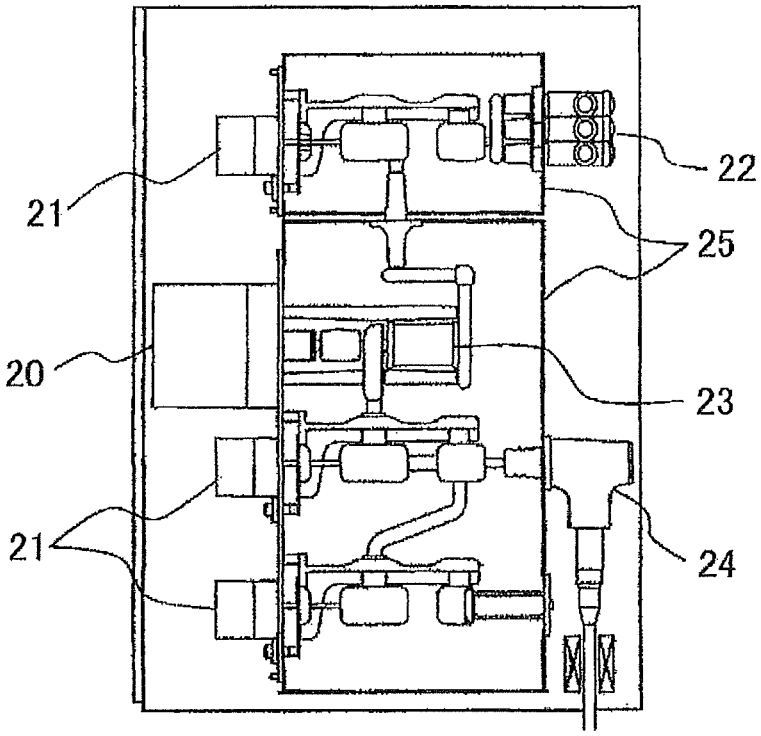
FIG. 1 is an overall configuration diagram of gas-insulated switchgear device used for the present invention.

Hereinafter, Embodiment 1 of the present invention will be explained. FIG. 1 is an overall configuration diagram of gas-insulated switchgear in which an electromagnetically operated switching device of the present invention is installed.

In FIG. 1, two gastight enclosures 25, in which insulating gas is respectively filled, are housed in a main body 100 of the gas-insulated switchgear. An isolator and a ground switch, which are connected to a bus 22, are housed in the upper gastight enclosure. Although only one-phase unit is shown in FIG. 1, the gas-insulated switchgear is composed of multiple-phase units, as three-phase units, which are disposed in parallel at a predefined separation in a back side direction with respect to a plane in FIG. 1.

Meanwhile, the lower gastight enclosure has a configuration in which a circuit breaker component and a plurality of switch components are disposed with a predefined upper-lower relationship. Here, the lower gastight enclosure has a three-tier configuration in which a vacuum valve 23 is disposed at an upper tier, and horizontally-arranged components including an isolator and a ground switch are disposed at a middle tier, and moreover, the other horizontally-arranged components including an arrester, a ground switch and the like are disposed at a lower tier. An operation mechanism of the isolator for electrically isolating the switching device from a power system is housed in isolator-operation-mechanism storing portions 21, and the electromagnetically operated switching device for opening/closing a contact of the vacuum valve 23 is housed in a switch storing portion 20. The gas-insulated switchgear configured as described above receives electric power via a cable head 24 and supplies the electric power to end-use devices via the bus 22.

Figure 2:
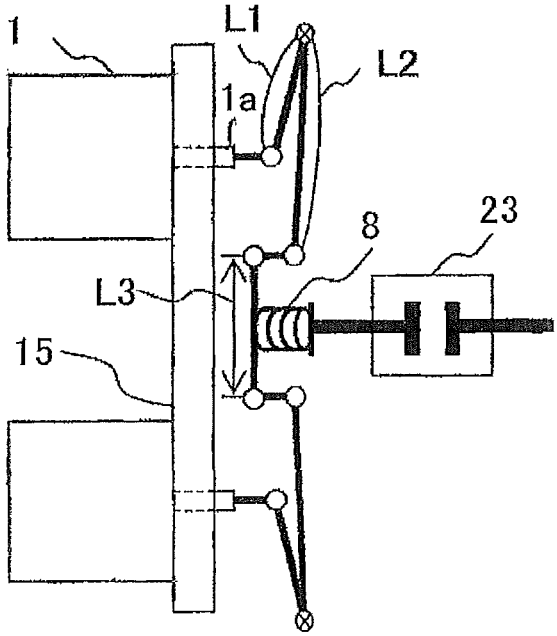
FIG. 2 is a principle diagram of a link mechanism in an electromagnetically operated switching device of the present invention.

FIG. 2 is a principle diagram of a link mechanism in an electromagnetically operated switching device used in Embodiment 1 of the present invention, and only one-phase link mechanism is illustrated. The link mechanism is symmetrically arranged in an axis direction of a center axis, and an operational force and a stroke are combined and transmitted to a contact-pressure spring 8 disposed along the center axis by concurrently driving two upper-lower electromagnetically operated mechanisms 1, whereby a main circuit contact of the vacuum valve 23 is opened or closed. Here, in order to avoid a complicated matter for the components symmetrically arranged in an upper-lower direction, symbols are assigned to only the unilateral components in FIG. 2.

The link mechanism is supported by a mechanical base 15 and formed so as to enlarge a stroke of a driving rod 7 (refer to FIG. 3) with respect to a stroke of a movable shaft 1*a* of the electromagnetically operated mechanisms 1, and ratio of the strokes is determined at a ratio of a length "L1" to a length "L2".

In addition, although a detail of the link mechanism will be explained later, "L3" indicates a length of the spring retaining plate 6 between pins 13 (refer to FIG. 3), and the link mechanism accommodates to a variation of a link ratio, by regulating a length L3, according to a change of the stroke or the contact pressure.

Figure 3:
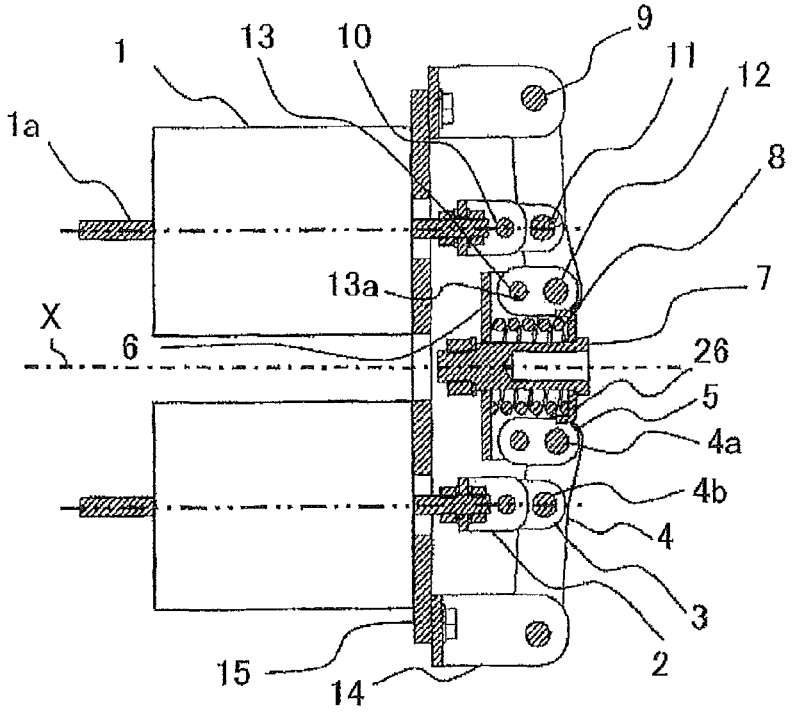
FIG. 3 is a cross-sectional diagram of an electromagnetically operated switching device (at the time of closing an electrode) according to Embodiment 1 of the present invention.

FIG. 3 is a cross-sectional diagram illustrating a configuration of the electromagnetically operated switching device used in Embodiment 1 of the present invention, and a closing state of an electrode of the vacuum valve 23 is illustrated. In FIG. 3, components accommodating to only one-phase unit are illustrated, and the same components are provided for each of the other-phase units.

Hereinafter, the configuration in FIG. 3 will be explained in detail. The electromagnetically operated mechanisms 1 are fixed to, for example, the mechanical base 15 which is solidly supported by the gastight enclosures 25, and a driving force of the movable shaft 1*a* is transmitted to the driving rod 7, which exists along the center axis X and opens/closes the main circuit contact of the vacuum valve 23, via the link mechanism that is explained below. The contact-pressure spring 8, which is inserted between a spring-support portion 26 and a spring retaining plate 6 that can be slidably linked to the driving rod 7, is provided around the driving rod 7.

In the link mechanism, an end portion of the movable shaft 1*a* of the electromagnetically operated mechanisms 1 is conned to interlocking link 2, and the interlocking link 2 is rotatably linked to a first link 3 by a pin 10. Moreover, the first link 3 is linked to a driving lever 4 by a pin 11, and one end portion of the driving lever 4 is rotatably linked to a fixing plate 14, which is fixed to the mechanical base 15 by a screw or the like, by a pin 9, and the other end portion of the driving lever 4 is rotatably linked to a second link 5 by a pin 12. Furthermore, the second link 5 is linked to the spring retaining plate 6 via a pin 13, and the operation force and the stroke are transmitted to the driving rod 7 and the contact-pressure spring 8, which are disposed along the operational center axis X, via the first link 3, the driving lever 4, the second link 5, and the spring retaining plate 6. In addition, the pin 9 is used for a fulcrum of the link mechanism.

Although a full length of the link mechanism is determined in accordance with the mechanical base 15, a design change of components, which are separated from the mechanical base 15 and disposed at a side of the electromagnetically operated mechanisms 1, cannot be performed because the design is standardized, so that a design change of the other components, which are separated from the mechanical base 15 and disposed at a side of the vacuum valve 23, is usually performed.

Hereinafter, operations in Embodiment 1 will be explained. As illustrated in FIG. 3, the operation force of the movable shaft 1*a* of the electromagnetically operated mechanism 1 operates to a link point 4*b* of the driving lever 4 that is linked by an interlocking link 2 and combined via the first link 3. The operation forces of the electromagnetically operated mechanisms, which are symmetrically arranged in an upper-lower direction, are similarly operated. Because the driving lever 4 is supported by the pin 9 which is a support point, an operation point 4*a* of the driving lever 4 is driven by the driving force operated to the link point 4*b*, and the operational force is applied to the spring retaining plate 6 via the second link 5. Thereby, a totalized driving force of the electromagnetically operated mechanisms, which are symmetrically arranged in an upper-lower direction, is transmitted to the driving rod 7 and the contact-pressure spring 8 so as to apply the necessary stroke in a center axis direction, and the operation force in a pressing direction is applied to the contact-pressure spring 8.

At this time, a rotational distance of the operation point 4*a* is increased, in accordance with a link ratio (L1:L2) for the link mechanism, with respect to a rotational distance of the link point 4*b*, and a stroke on the center axis X becomes link-ratio times of a stroke of the electromagnetically operated mechanisms 1. Here, L1 indicates a length between the pin 9 and the pin 11, and L2 indicates a length between the pin 9 and the pin 12.

Figure 4:
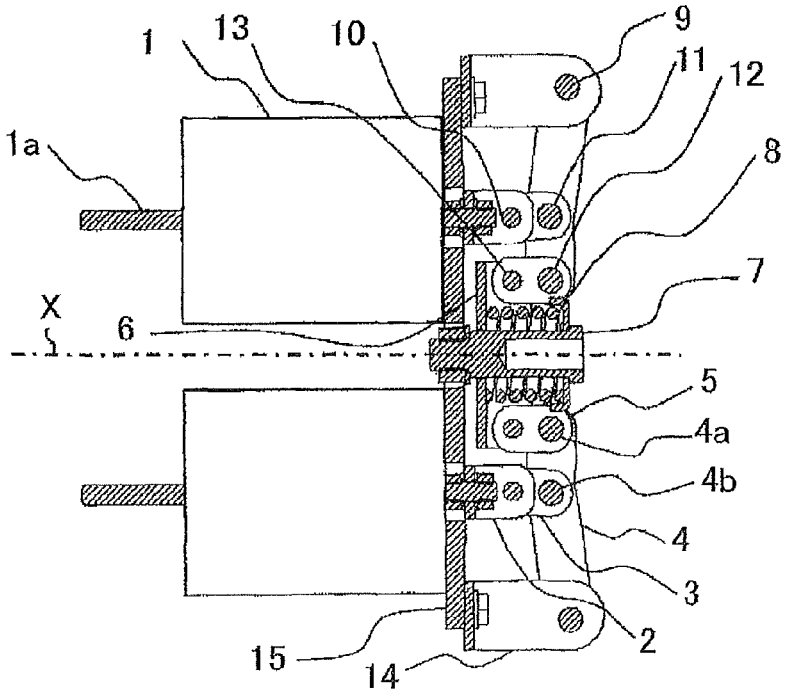
FIG. 4 is a cross-sectional diagram of an electromagnetically operated switching device (at the time of opening an electrode) according to Embodiment 1 of the present invention.

FIG. 3 illustrates a diagram in a state where an electrode of the electromagnetically operated switching device is closed. In this state, when the driving lever 4 is driven in an electrode-opening direction (in a left direction with respect to a plane in FIG. 3) of the driving lever 4, the link mechanism becomes an opening state of the electrode illustrated in FIG. 4. In the opening state of the electrode illustrated in FIG. 4, when the driving lever 4 is driven in an electrode-closing direction (in a right direction with respect to a plane in FIG. 4) of the main circuit contact, the driving lever 4 is returned to the closing state of the electrode illustrated in FIG. 3.

As described above, the electromagnetically operated switching device according to Embodiment 1 includes a pair of the electromagnetically operated mechanisms 1 for driving the main circuit contact of the switch via the link mechanism which is symmetrically arranged with respect to the operational center axis, and a length of the spring retaining plate 6 in a rectangular direction with respect to the operational center axis can be regulated in accordance with a change of the link ratio which is caused by a design change of the main circuit contact.

Thereby, even when the link ratio (L1:L2) is varied in accordance with a change of the stroke or the contact pressure, and when the link ratio is small in particular, design for the length (L3) of the spring retaining plate 6 between the pins 13 can be easily varied, so that the link ratio can be varied without affecting an arrangement of the electromagnetically operated mechanisms 1.

Figure 5:
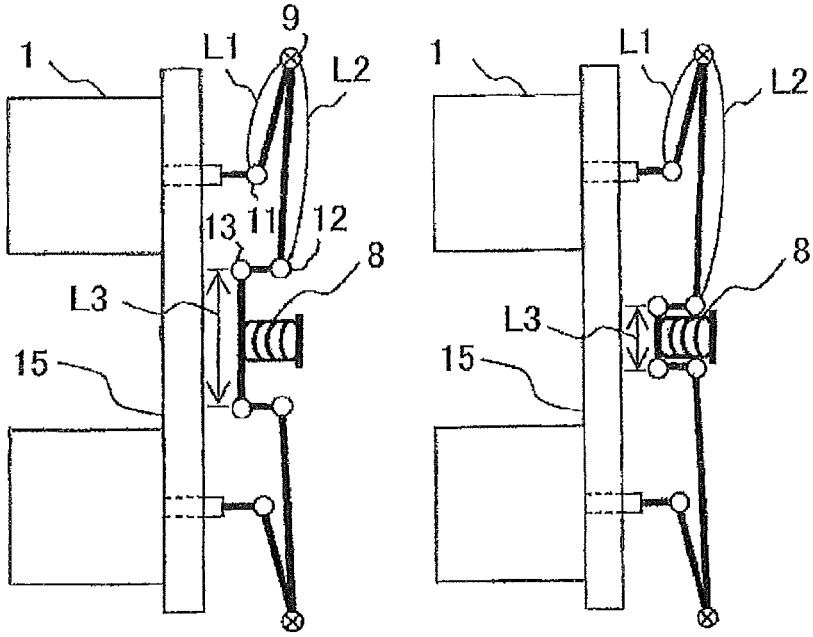
FIG. 5 are exemplary diagrams in a case where a link ratio is varied for the link mechanism of the present invention.

FIG. 5 are examples illustrating principle diagrams of the link mechanism in a case where a link ratio is varied, and FIG. 5(*a*) is an exemplary diagram in a case where a link ratio is 1-1.5, and FIG. 5(*b*) is an exemplary diagram in a case where a link ratio is 1-2. In FIG. 5, L1 indicates a length between the pin 9 of the driving lever 4 and the pin 11 on which the link point 4*b* exists, and L2 indicates a length between the pin 9 of the driving lever 4 and the pin 12 on which the operation point 4*a* of the second link 5 exists, and L3 indicates a length of the spring retaining plate 6 in a rectangular direction with respect to the center axis X.

Here, when a change of a link ratio involved in a change of the stroke or the contact pressure is caused by a design change of the stroke or the contact pressure, which is determined in accordance with an insulation level, a continuous passing current, or a short-time current of the main circuit of the switch, for example, when a link ratio (L1:L2=1:1.5) illustrated in FIG. 5(*a*) is changed to a link ratio (L1:L2=1:2) illustrated in FIG. 5(*b*), a total length of the link mechanism can be regulated by replacing the spring retaining plate 6 with another plate that is suitable for the change of the link ratio, which is the simplest method, without changing an arrangement of the electromagnetically operated mechanisms, in other words, without changing a configuration or an installation position of the electromagnetically operated mechanisms.

For example, there are methods, including another method other than a method of simply replacing the spring retaining plate 6, for providing a long groove or the like on the spring retaining plate 6, for example, in such a way that a position of the pin 13 for linking the spring retaining plate 6 to the interlocking link 2 can be moved in a rectangular direction with respect to the operational center axis. In short, it is only necessary to provide a configuration by which a length between the spring retaining plate 6 and the pin 13 for linking the spring retaining plate 6 to the interlocking link 2 can be regulated.

According to Embodiment 1 as described above, the link mechanism can be simply accommodated to a design change of the stroke or the contact pressure of the main circuit contact, while a shared use of the electromagnetically operated mechanisms is advanced in accordance with the change of the stroke or the contact pressure.

Here, although an electromagnetically operated switching device, in which driving forces of two electromagnetically operated mechanisms per one phase are combined, is explained in Embodiment 1, the present invention is similarly applied to another electromagnetically operated switching device driven by one electromagnetically operated mechanism. In this case, it is satisfied for the switching device that a length (corresponding to L3/2) from a center point (a position of the center axis) of the spring retaining plate 6 to a link point for linking the spring retaining plate 6 with the second link 3 is regulated in accordance with a design change of the stroke or the contact-pressure force.

Moreover, the pin 10 for linking the interlocking link 2 to the first link 3 and the pin 11 for linking the first link 3 to the driving lever 4 are arranged along the same straight line, along which the movable shaft 1*a* of the electromagnetically operated mechanism 1 is also arranged. In other words, a force-line direction of the interlocking link 2 exists along the same axis corresponding to the movable shaft 1*a* of the electromagnetically operated mechanism 1, whereby the driving force of the electromagnetically operated mechanism 1 is effectively transmitted to the operation point 4*a* of the driving lever.

Embodiment 2

Figure 6:
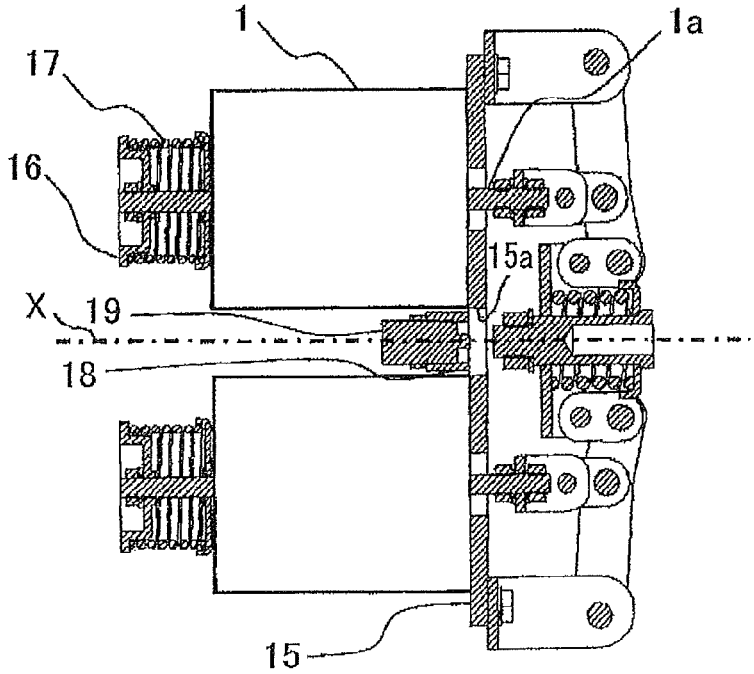
FIG. 6 is a cross-sectional diagram of an electromagnetically operated switching device (at the time of closing an electrode) according to Embodiment 2 of the present invention.

FIG. 6 is a cross-sectional diagram illustrating a configuration of an electromagnetically operated switching device according to Embodiment 2 of the present invention, and a closing state of an electrode is illustrated. In Embodiment 2, additional configuration components are added to the electromagnetically operated switching device according to Embodiment 1. In other words, a spring retaining member 16 is fixed to a movable shaft 1*a* protruded from an electromagnetically operated mechanism 1, and a spring 17 is provided between the spring retaining member 16 and the electromagnetically operated mechanism 1.

By forming the electromagnetically operated switching device as described above, a compressive force is accumulated in the spring 17 at the operation time of closing the electrode, and an operation of opening the electrode can be supported by using the compressive force at the operation time of opening the electrode. Moreover, when the operation of opening the electrode is terminated, an opening state of the electrode can be supported by the spring 17, so that operation energy and a sustain force at the time of opening the electrode of the electromagnetically operated mechanism 1 can be replenished.

Moreover, in Embodiment 2, a damper plate 18 and a damper 19 are arranged along a center axis of a mechanical base 15 in FIG. 6. Although a driving rod 7 is inserted in or exited from a hole 15*a*, which is formed in the mechanical base 15, in accordance with the operation of the electromagnetically operated mechanism 1 as described above, the driving rod 7 is damaged by a repeated impact, or a noise is caused by the repeated impact. In order to counteract the impact, the electromagnetically operated switching device includes a well-known buffer means at a portion, which is opposed to the driving rod 7, of the electromagnetically operated mechanism side of the mechanical base 15. The damper 19 is obviously configured with an elastic material, and the damper 19 absorbs and alleviates extra energy when the electromagnetically operated switching device is shifted from the closing state of the electrode to the opening state of the electrode, whereby the link mechanism is protected.

INDUSTRIAL APPLICABILITY

The present invention can be widely applied to an electromagnetically operated mechanism of a switch, such as a circuit breaker, an isolator, or a ground switch, which is used for an electric power transmission-distribution facility, an electric power receiving facility and the like.

DESCRIPTION OF THE SYMBOLS

"1" is an electromagnetically operated mechanism; "1*a*," a movable shaft; "3," a first link; "4," a driving lever; "4*a*," an operation point; "4*b*," a link point; "5," a second link; "6," a spring retaining plate; "7", a driving rod; "8," a contact-pressure spring; "9,10,11,12,13" pins; "13*a*," a link point; "14," a fixing plate; "15," a mechanical base; "16," a spring retaining member; "15*a*," a hole; "17," a spring; "18," a damper plate; "19," a damper; "20," a switch storing portion; "21," isolator-operation-mechanism storing portions; "22," a bus; "23," a vacuum valve; "24," a cable head; "25," tanks; "26," a spring-support portion; "100," a main body of gas-insulated switchgear.

What is claimed is:

1. An electromagnetically operated switching device comprising:

electromagnetically operated mechanisms for opening/closing a main circuit contact of a switch;

a link mechanism for transmitting operation forces of the electromagnetically operated mechanisms to the main circuit contact of the switch;

a driving rod that is arranged along an operational center axis of the main circuit contact;

a contact-pressure spring that is disposed around the driving rod and applies a necessary contact pressure to the main circuit contact;

a spring retaining plate linked to the driving rod so as to retain the contact-pressure spring;

wherein the link mechanism includes an interlocking link for transmitting a stroke of the electromagnetically operated mechanisms, a first link rotatably linked to the interlocking link, a second link rotatably linked to the spring retaining plate, and a driving lever with one end portion rotatably linked to a support point of a fixing plate and an other end portion of the driving lever rotatably linked to the second link;

a length from an operational center axis of the spring retaining plate to a link point linking the spring retaining plate with the second link is configured in accordance with a change of a link ratio for the link mechanism; and wherein the link ratio for the link mechanism is a ratio between a length from the support point of the fixing plate to a link point linking the second link with the other end portion of the driving lever, and a length from the support point of the fixing plate to a link point for linking the first link with the driving lever.

2. An electromagnetically operated switching device as recited in claim 1, wherein a length of the spring retaining plate in a direction orthogonal to the operational center axis and extending towards the link mechanism can be regulated in accordance with a change of the link ratio for the link mechanism.

3. An electromagnetically operated switching device as recited in claim 2, wherein a plurality of link mechanisms are symmetrically arranged with respect to the operational center axis of the main circuit contact, and each of the operation forces of the electromagnetically operated mechanisms, which are transmitted via the link mechanisms, is combined and applied to the spring retaining plate.

4. An electromagnetically operated switching device as recited in claim 2, wherein a force-line direction of the interlocking link exists along the same axis corresponding to a movable shaft of the electromagnetically operated mechanisms.

5. An electromagnetically operated switching device as recited in claim 2, wherein a buffer device for absorbing and alleviating an operation force, which is generated on the driving rod, along the operational center axis, when the switch is shifted from a closing state of an electrode to an opening state of the electrode.

6. An electromagnetically operated switching device as recited in claim 1, wherein the spring retaining plate is configured to be replaceable with another spring retaining plate having a different length, in accordance with a change of the link ratio for the link mechanism without changing the arrangement of the electromagnetically operated mechanisms relative to the driving rod.

7. An electromagnetically operated switching device as recited in claim 6, wherein a plurality of link mechanisms are symmetrically arranged with respect to the operational center axis of the main circuit contact, and each of the operation forces of the electromagnetically operated mechanisms, which are transmitted via the link mechanisms, is combined and applied to the spring retaining plate.

8. An electromagnetically operated switching device as recited in claim 6, wherein a force-line direction of the interlocking link exists along the same axis corresponding to a movable shaft of the electromagnetically operated mechanisms.

9. An electromagnetically operated switching device as recited in claim 6, wherein a buffer device for absorbing and alleviating an operation force, which is generated on the driving rod, along the operational center axis, when the switch is shifted from a closing state of an electrode to an opening state of the electrode.

10. An electromagnetically operated switching device as recited in claim 1, wherein a plurality of link mechanisms are symmetrically arranged with respect to the operational center axis of the main circuit contact, and each of the operation forces of the electromagnetically operated mechanisms, which are transmitted via the link mechanisms, is combined and applied to the spring retaining plate.

11. An electromagnetically operated switching device as recited in claim 1, wherein a force-line direction of the interlocking link exists along the same axis corresponding to a movable shaft of the electromagnetically operated mechanisms.

12. An electromagnetically operated switching device as recited in claim 1, wherein a buffer device for absorbing and alleviating an operation force, which is generated on the driving rod, along the operational center axis, when the switch is shifted from a closing state of an electrode to an opening state of the electrode.

* * * * *